United States Patent [19]

Kupperman et al.

[11] 4,179,841

[45] Dec. 25, 1979

[54] TOY OBJECT THAT PROPELS FORWARD, SUBMERGES AND SURFACES

[75] Inventors: Sam Kupperman, Chicago; Dennis Kupperman, Glenview, both of Ill.

[73] Assignee: RB Toy Development Co., Skokie, Ill.

[21] Appl. No.: 850,948

[22] Filed: Nov. 14, 1977

[51] Int. Cl.[2] ..... A63H 23/04

[52] U.S. Cl. ..... 46/94

[58] Field of Search ..... 46/92, 93, 94, 95, 96, 46/250

[56] References Cited

U.S. PATENT DOCUMENTS

| | | | |
|---|---|---|---|
| 2,749,658 | 6/1956 | Neumann | 46/92 |
| 2,777,248 | 1/1957 | Hirsch et al. | 46/95 |
| 3,251,154 | 5/1966 | Taylor | 46/94 X |
| 3,307,290 | 3/1967 | Pedersen | 46/250 X |
| 3,935,665 | 2/1976 | Tong | 46/92 X |

*Primary Examiner*—F. Barry Shay

*Attorney, Agent, or Firm*—Vogel, Dithmar, Stotland, Stratman & Levy

[57] ABSTRACT

A toy object such as a submarine or the like with a ballast chamber and an air chamber dimensioned such that normally in a static position the body floats in water with only a small portion of the body extending out of the water. The ballast chamber is filled with water and the air chamber is buoyant and causes the top object to float. Diving planes extend outwardly from the body such that when a motor is activated the toy moves forward, submerges and stays submerged so long as there is forward motion. When the motor stops the toy object rises to its static position.

9 Claims, 7 Drawing Figures

TOY OBJECT THAT PROPELS FORWARD, SUBMERGES AND SURFACES

BACKGROUND OF THE INVENTION

Toy objects, such as submarines, which repeatedly submerge and rise in water are a well known art. For instance, U.S. Pat. No. 4,052,812 issued to us, Oct. 11, 1977 for TOY OBJECT THAT REPEATEDLY SUBMERGES AND RISES IN THE WATER, discloses a type of toy which utilizes an effervescent material to submerge and rise repeatedly upon the formation of a gas bubble and subsequent release of same. This type of toy has been used successfully as a premium item in distribution with breakfast foods and the like.

Another type of toy object is one which uses a rubberband motor to propel the toy forward in the water and during the forward movement the toy submerges and after the motor expends itself, then the toy object rises. The closest prior art known to the applicants herein consists of a plastic cylinder in the form of a submarine having a separate chamber fabricated and glued inside the cylinder to provide buoyancy and a metal shaft extending outwardly with a hard plastic propeller on the metal shaft. A rubberband extends from the inner end of the metal shaft to the forward end of the cylinder. The plastic used for the cylinder body in the shape of a submarine is different than the plastic used for the propeller. A series of slots is provided in the bottom of the cylinder to allow water to enter and five spaced apart apertures are provided in the simulated conning tower to allow water or air to escape from the cylinder when water enters same, thereby to provide ballast to allow the object to sink in the water. The metal shaft extends through an aperture at the rear juncture of the two halves, the juncture lying in a horizontal plane when the toy object floats in the water. No bearings or other devices are provided to facilitate rotation of the metal shaft and the propeller thereon. The propeller is at the distal end of the metal shaft.

The prior art device described above is unsuitable for use as a premium, due to the required hand assembly as well as the variety of materials used. Furthermore, the toy is inefficient at best and borders on inoperative as the coefficient friction between the metal shaft and the plastic body is such that the shaft does not rotate easily within the body, and hence, the propeller does not adequately move the object forward through the water.

BRIEF DESCRIPTION OF THE INVENTION

This invention relates to a toy which may be used as a premium and which can be molded as a single integral piece of plastic forming two halves which when assembled coact to form both a buoyant air chamber and a ballast chamber, and more particularly, this invention relates to a two-part toy in which the two parts coact to form the aforesaid chambers and to form a bearing to facilitate rotation of the motor drive shaft and propeller so as to provide improved operation of the toy.

An important object of the present invention is to provide a toy object which is easy to assemble by snap fitting two halves together which automatically provide both the ballast chamber and a buoyant air chamber.

A further object of the present invention is to provide a toy object comprising a body having a ballast chamber and a buoyant air chamber dimensioned that normally said body floats in water with a portion of said body extending out of the water, said body being formed of separate members with each member forming a portion of said ballast and buoyant air chambers, diving planes extending outwardly from said body angularly disposed to the horizontal when said body floats such that forward movement of said body through the water causes said body to submerge, and motor means associated with said body having a propeller extending outwardly of said body and having an energy storage device connected to said propeller for causing same to rotate, rotation of said propeller causing forward movement of said body through the water and simultaneous submerging of said toy object below the water surface until said propeller ceases to rotate when said body rises until said portion extends out of the water.

Yet a further object of the present invention is to provide a toy object of the type set forth in which one member provides a bearing at the rear thereof to facilitate rotation of the shaft journalled, which shaft is provided with a knurled portion at the distal end thereof extending outside of the toy to facilitate winding of the shaft, and hence, the energy storing device connected thereto.

These and other objects of the subject invention may be more readily understood by reference to the following specification taken in connection with the accompanying drawings, in which:

DESCRIPTION OF THE PREFERRED EMBODIMENT

Figure 1:
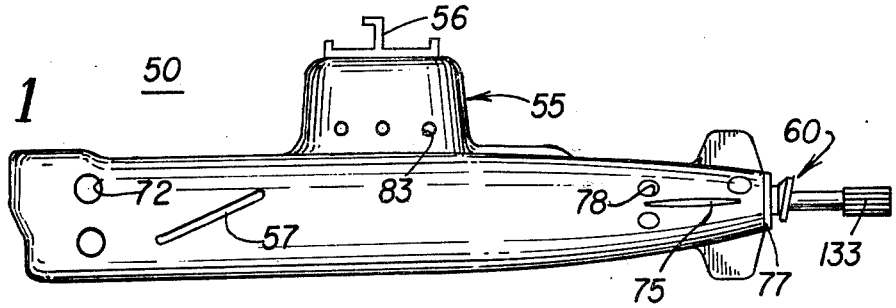
FIG. 1 is a side elevational view of a toy object embodying the principles of the subject invention.
Figure 2:
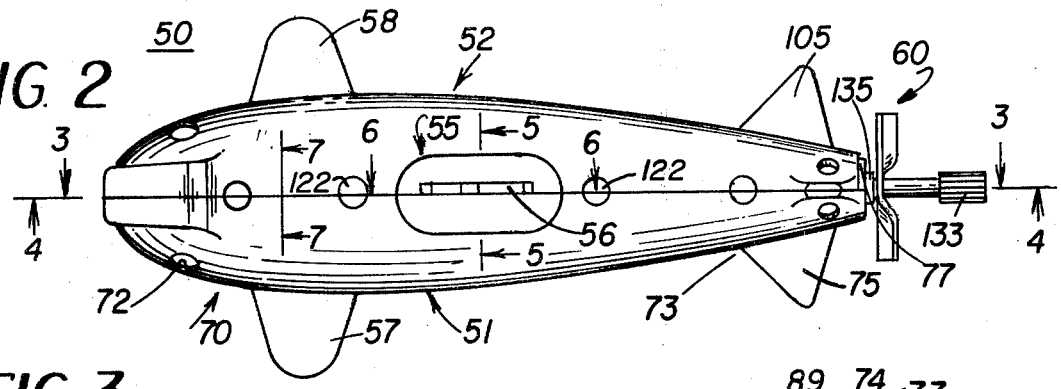
FIG. 2 is a top plan view of the toy object illustrated in FIG. 1.

Referring now to the drawings, there is disclosed a toy object 50 in the form of a submarine comprised of a first member 51 and a second member 52 frictionally joined together to form the submarine body 70. The toy 50 is provided with a simulated conning tower 55 having periscopes 56 extending upwardly therefrom. Diving planes 57 and 58 extend outwardly from each of the members 51 and 52 respectively and are angularly disposed with respect to the horizontal such that forward movement of the submarine 50 through the water causes the submarine to nose down and dive. Propulsion of the toy submarine 50 through the water is provided by rotation of a propeller 60 connected to motor mechanism 61 housed within the submarine and particularly the body 70 formed by the members 51 and 52. Normally, the toy submarine 50 floats in the water with only the conning tower 55 extending out of the water, but when the propeller 60 rotates, the toy submarine dives or submerges and is propelled forwardly totally underneath the water until such time as the propeller 60 ceases to rotate, whereupon the toy submarine rises through the water until once again it resumes its static position wherein the conning tower 55 extends out of the water. This action is provided in part by the coaction of a ballast chamber 63 formed by the two members 51 and 52 and a buoyant air chamber 64 also formed by the coaction of the members 51 and 52, as will hereinafter be set forth.

Figure 3:
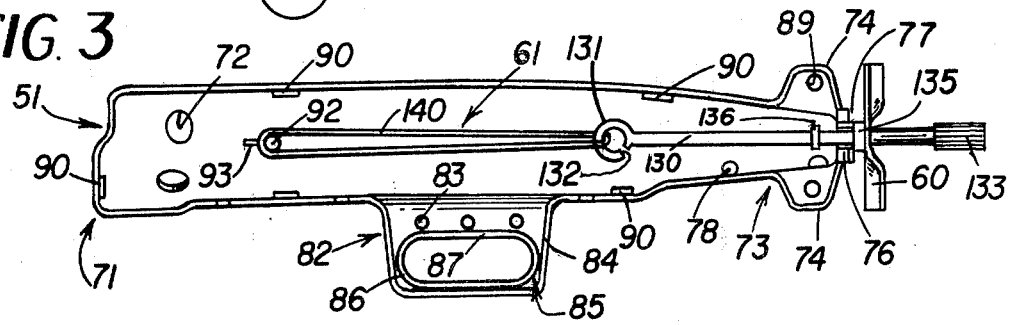
FIG. 3 is a side elevational view of one member of the toy object shown in FIG. 2, as seen in the direction of the arrows 3—3.

The members 51 and 52 snap fit together to form a body or hull 70 which includes the conning tower 55 and all other portions hereinbefore set forth. Referring now to FIG. 3, there is the "inside" of the member 51 having a bow area 71 and a stern area 73 with the bow area being provided with spaced apart apertures 72 and the stern area being provided with outwardly extending fins 74 which in use are vertically oriented and an outwardly extending fin 75 which in use is horizontally oriented. The rear of the member 51 is formed into a bearing 76 having a half collar 77 outwardly thereof, the bearing and collar forming an enlarged and smooth arcuate surface for a purpose hereinafter set forth. Spaced apart apertures 78 are provided in the stern area of the member 51, and one aperture 89 is formed in each fin 74.

Figure 5:
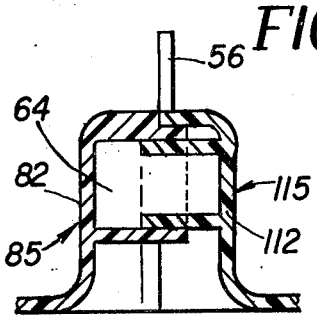
FIG. 5 is a view in section of the buoyant air chamber of the toy object illustrated in FIG. 2, as seen along the lines 5—5.

The member 51 is provided with a conning tower area 82 including the upstanding walls 84 and a plurality of apertures 83 positioned near the base of the conning tower area, that is near the juncture of the conning tower and the body or hull 70. The member 51 contributes a portion of the buoyant air chamber 64 which is defined by an air chamber outer wall 85 being formed of two arcuate end portions 86 interconnected by straight upstanding body portions 87. As best seen in FIG. 5, the wall 85 extends outwardly beyond the rim of the body member 51 and particularly outwardly beyond the conning tower portion 82 thereof.

A plurality of alignment members 90 are positioned on the inner surface of the member 51 and extend outwardly therefrom beyond the peripheral edge of the member. A post 92 having a forwardly extending bevel centering guide 93 connected thereto is attached to the body member 51 as at 94, the post 92, the guide 93 and the body member 51 preferably being an integral one-piece molded unit. This is also true with respect to the entire member 51 described including the conning tower area 82 and the air chamber outer wall 85, all of which is a single integral one-piece, molded in one shot, synthetic organic resin.

Figure 4:
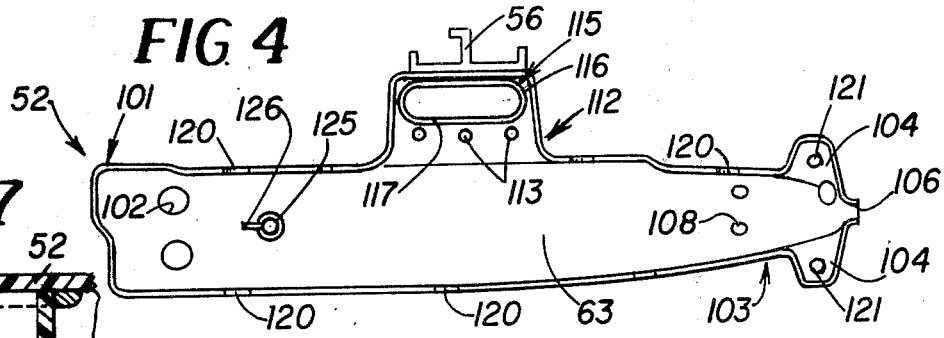
FIG. 4 is a side elevational view of the other member of the toy object illustrated in FIG. 2, as seen from the direction of the arrows 4—4.
Figure 7:
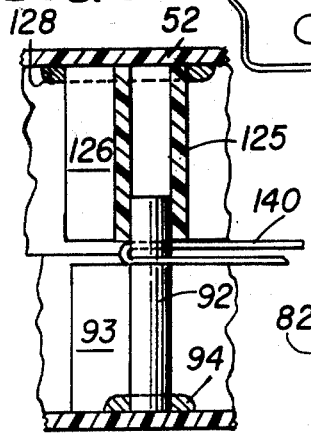
FIG. 7 is a view in section of the toy object illustrated in FIG. 2, as viewed along the lines 7—7 thereof.
Figure 6:
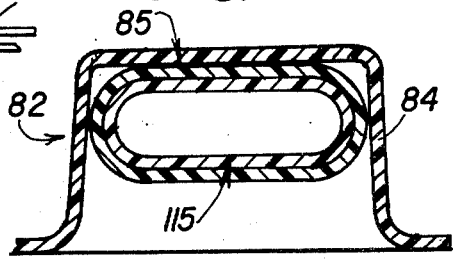
FIG. 6 is a view in section of the buoyant air chamber of the toy object illustrated in FIG. 2, as seen along the lines 6—6.

Referring now to FIG. 4, the member 52 is illustrated and includes a bow area 101 and a stern area 103, the bow area being provided with a plurality of apertures 102 and the stern area being provided with upstanding vertical fins 104 and complimentary in size and shape to the fins 74 and a single horizontally extending fin 105 complimentary in size and shape and location to the fin 75. A bearing seat 106 is provided at the rear most end of the member 52 and serves with the bearings 76 and the half collar 77 to provide a smooth bearing surface for the motor mechanism 61, as will be explained. A plurality of apertures 108 are provided in the stern area 103 corresponding in number and location substantially to those apertures 78 in the member 51. A conning toward area 112 is provided in the member 52 located in registry with the conning tower area 82 of the member 51. It is herein noted that the two members 51 and 52 snap fit together, and therefore, the peripheral dimensions of the two members 51 and 52 must be complimentary such that when fitted together a smooth body or hull 70 is provided. Apertures 113 are provided in the conning tower area in registry with the apertures 83. An air chamber inner wall 115 extends outwardly from the inner surface of the member 52 and extends beyond the peripheral edge of the body member 52 (see FIG. 5) and is formed of two spaced apart arcuate end portions 116 interconnected by straight wall portions 117. The air chamber inner wall 115 is dimensioned to fit snugly within the air chamber outer wall 85 and frictionally to engage the inner surface of the outer wall 85 thereby to provide a water tight buoyant air chamber 64.

Apertures 120 in the edge of the body member 52 cooperate with like apertures in the edge of the body member 51 to provide a plurality of spaced circular apertures 122 along the juncture of the members 51 and 52. Two posts 121 extend outwardly from the inner surface of the fins 104, which posts are dimensioned to fit securely within the apertures 89 in the fins 74 thereby to ensure frictional engagement of the members 51 and 52.

Near the forward end or bow area of the member 52, there is a sheath 125 dimensioned to receive therein the post 92, the sheath having a second band centering guide 126 extending forwardly thereof and attached to the member 52 as at 128. It is preferred that the sheath, the guide 126 and the attachment means 128 be integrally molded with the member 52.

The motor mechanism 61 includes an elongated shaft 130 having an eye 131 with an opening 132 formed at one end thereof and a knurled portion 133 at the other end thereof. A propeller collar 135 at the juncture of the propeller 60 and the shaft 130 provides strength and acts as a positioner for the propeller. A flange 136 spaced inwardly from the propeller 60 serves to prevent the shaft 130 from being pulled too far out of the assembled hull or body 70, and hence, is also a positioner in the same fashion as the collar 135. A rubberband or other elastic member 140 interconnects the post 92 and sheath 125 with the shaft 130 and particularly the eye 131, the rubberband serving as energy storing device.

The members 51 and 52 as well as the shaft 130 and propeller 60 are integrally molded in one-piece and are interconnected by a series of links (not shown). When the members 51 and 52 are severed from the connecting links, the rubberband 140 which is provided separately is positioned as shown in FIG. 3 between the band centering guides 93 and 126 to be in contact with the post 92 and the distal end of the sheath 125. Thereafter, the members 51 and 52 are aligned in registry and snap fitted together with the post 92 and sheath 125 as well as the posts 121 serving to maintain the two members together to form the hull or body 70 and to maintain the shaft 130 in the completed bearing formed by the members 76 and 106. During the snap fit of the members 51 and 52, air is trapped within the chamber 64 formed by the frictional engagement of the inner wall 115 and the outer wall 85, thereby to provide the buoyant air chamber 64. The ballast chamber 63 is formed by the members 51 and 52 and when the toy 50 is introduced into the water, water immediately fills the ballast chamber 63 through the various apertures therein with the apertures on the top of the toy 50 allowing air to escape easily thereby facilitating the rapid filling of the ballast chamber. In a static condition, the toy 50 floats in the water with principally only the conning tower 55 extending outwardly.

Potential energy is stored in the elastic member or rubberband 140 by rotating the knurled end 133 of the shaft 130. After sufficient energy has been stored in the member 140, the shaft 130 is released and the conversion of the potential energy stored in the rubberband to kinetic energy results in rotation of the propeller 60 causing the toy object 50 to move forwardly in the water. Due to the angle of the diving planes 57 and 58, forward movement of the toy object or submarine 50 causes the bow portion thereof to nose downwardly and continued forward movement causes the submarine to dive or submerge. After the energy in the rubberband 140 has been exhausted, and the propeller 60 ceases to rotate, the submarine 50 once again rises to the surface of the water to resume its static or at rest condition. The knurled end 133 of the shaft 130 provides easy operation of the motor mechanism 61 and the smooth bearing surfaces formed by the bearing 76 and the bearing seat 106 combine to provide smooth operation of the shaft 130.

The static condition or level of the submarine 50 in the water is determined by the weight of the material in the submarine 50 as well as the size of the buoyant air chamber 64. It is imperative to the operation of the toy 50 that the air of buoyant air chamber 64 remain water tight no matter how rough the toy is handled. Accordingly, the outer and inner walls 85 and 115 respectively, overlap to a considerable extent and in each case the walls extend beyond the associated member 51 and 52 respectively. It is this overlapping configuration in combination with the friction fitting of the members 51 and 52 that ensures the watertight nature of the chamber 64.

Another feature of the present invention is the fact that each member 51 and 52 coacts to form both the ballast chamber 63 and the buoyant air chamber 64. Further, each of the members 51 and 52 coact to form an improved bearing surface for the shaft 130, thereby providing improved rotation of the propeller 60 and hence, improved operation of the entire toy 50.

A still further feature of the present invention is the knurled end 133 of the shaft 130 which extend beyond the propeller 60 outside of the hull or body 70 enabling potential energy to be stored in the motor mechanism 61 relatively easily, and provides a great improvement over the prior art device.

A still further feature of the present invention is the improved connection for the energy storage or rubberband 140 at the forward end of the submarine comprised of the post and sheath 92 and 125 which ensures that the motor mechanism 61 is centrally retained during operation of the submarine 50 preventing canting of the propeller 60 during operation.

Another important feature of the present invention, particularly with respect to its use as a premium toy, is the fact that the entire construction with the exception of the rubberband 140 is made from the same synthetic organic resin as one-piece in a single shot, which resin is preferably high impact polystyrene. It is not necessary that the resin be limited to polystyrene or that the entire construction be made in a single shot, however, the preferred resin and method greatly reduces the production costs and enables the entire construction to be used as a premium.

While there has been illustrated what at present is considered to be the preferred embodiment of the present invention, and particularly the embodiment wherein the object is a simulated submarine, it is obvious that various modifications and alterations may be made therein without departing from the true spirit and scope of the present invention and it is intended to cover in the appended claims all such variations and modifications thereof.

What is claimed is:

1. A toy object comprising a body having a ballast chamber and a buoyant air chamber, said chambers being non-communicating with respect to each other and dimensioned such that normally said body floats in water with a portion of said body extending out of the water, said body being formed of separate substantially hollow nesting members with each member forming a portion of said ballast and buoyant chambers, said nesting members frictionally engaging one another to form said chambers, diving planes extending outwardly from said body angularly disposed to the horizontal when said body floats such that forward movement of said body through the water causes said body to submerge, and motor means associated with said body having a propeller extending outwardly of said body and having an energy storage device connected to said propeller for causing same to rotate, rotation of said propeller causing forward movement of said body through the water and simultaneous submerging of said toy object below the water surface until said propeller ceases to rotate when said body rises until said portion extends out of the water.

2. The object set forth in claim 1, wherein the juncture between said members lies in use in a vertical plane, and a plurality of apertures extending through said body permit water readily to enter said ballast chamber, said apertures being spaced along said body and adjacent both ends thereof.

3. The toy object set forth in claim 1, wherein each of said portions of said buoyant air chamber is integrally molded with the associated member.

4. The toy object set forth in claim 1, wherein each member has an exposed peripheral edge for mating with the associated edge of the other member, and wherein said bouyant chamber portions of said two nesting members extend outwardly beyond the associated edge of said members to provide overlapping of said bouyant chamber portions when nested and a watertight chamber.

5. The toy object set forth in claim 1, wherein said motor means includes an elongated shaft extending through a bearing formed by said members and a propeller integral with said shaft, said shaft having a knurled portion on the distal end thereof extending outside of said members.

6. The toy object set forth in claim 5, wherein said shaft has attachment means on the end thereof retained within said body, and further comprising means on at least one of said members connecting the energy storage device to said body.

7. The toy object set forth in claim 6, wherein said energy storage device is an elastic member extending between and connected to the attachment means on said shaft and the connecting means on said member.

8. The toy object set forth in claim 6, wherein said connecting means is a post mounted on one member and a complimentary sheath on the other member in registry with said post for receiving same when said members form said body, said post and sheath each carrying a centering fin extending therefrom defining a central slot when said post and sheath mate.

9. The toy object set forth in claim 1, wherein said body and said motor means are high impact polystyrene.

* * * * *